US005440988A

United States Patent [19]

Ito

[11] Patent Number: 5,440,988

[45] Date of Patent: Aug. 15, 1995

[54] METHOD AND APPARATUS FOR LOADING A PLATE IN A PRINTING PRESS

[75] Inventor: Mineyuki Ito, Gifu, Japan

[73] Assignee: Sakurai Graphic Systems Corporation, Japan

[21] Appl. No.: 251,912

[22] Filed: Jun. 1, 1994

[30] Foreign Application Priority Data

Nov. 26, 1993 [JP] Japan ..... 5-297039

[51] Int. Cl.[6] ..... B41F 21/00

[52] U.S. Cl. ..... 101/477; 101/415.1

[58] Field of Search ..... 101/216, 378, 382.1, 101/383, 415.1, 477, DIG. 36

[56] References Cited

U.S. PATENT DOCUMENTS

| | | | |
|---|---|---|---|
| 3,691,950 | 9/1972 | Gates | 101/415.1 |
| 5,127,328 | 7/1992 | Wieland | 101/415.1 |
| 5,309,832 | 5/1994 | Merkel et al. | 101/216 |
| 5,320,041 | 6/1994 | Maejima et al. | 101/415.1 |

FOREIGN PATENT DOCUMENTS

| | | | |
|---|---|---|---|
| 0777000 | 1/1968 | Canada | 101/415.1 |
| 0567754 | 11/1993 | European Pat. Off. | 101/415.1 |
| 0099332 | 4/1990 | Japan | 101/415.1 |
| 0179150 | 7/1991 | Japan | 101/415.1 |
| 4-284252 | 10/1992 | Japan . | |
| 0077401 | 3/1993 | Japan | 101/415.1 |
| 0162288 | 6/1993 | Japan | 101/415.1 |

*Primary Examiner*—Chris A. Bennett

*Attorney, Agent, or Firm*—Nawrocki, Rooney & Sivertson

[57] ABSTRACT

A plate loading device for a printing press is disclosed. In the printing press, a plate cylinder is rotatably supported in a housing. The device is arranged to replace a used plate wound on a peripheral surface of the cylinder with a new plate supplied through an entrance formed in the housing. The device further includes a cover for selectively closing and opening the entrance in accordance with the loading and unloading of the plate. The device also has holding members for holding the new plate at a predetermined position outside the cover when the cover is closed, and rollers for clamping, holding and guiding the new plate. The new plate is inserted through the entrance to be placed at a predetermined position on the plate cylinder so that the new plate may be wound on the plate cylinder in one direction.

16 Claims, 6 Drawing Sheets

METHOD AND APPARATUS FOR LOADING A PLATE IN A PRINTING PRESS

BACKGROUND OF THE INVENTION

1. Field of the Invention

The present invention relates to a printing press, and more particularly, to a plate loading method and device used for loading a plate in a predetermined position on a plate cylinder of the printing press.

2. Description of the Related Art

An offset press is typically constructed with three cylinders: a plate cylinder, a rubber blanket cylinder and an impression cylinder. In presses of this type, an inking system distributes ink and moisture to the plate cylinder which then transfers an ink image to the rubber blanket cylinder. The rubber blanket cylinder then transfers the image to a sheet of paper passing between the rubber blanket cylinder and the impression cylinder.

For efficient printing press operation, it is important to be able to transfer the printing plates on and off of the plate cylinder as quickly as possible. Typically, plates are prepared in the vicinity of the plate cylinder while the printing press is running. When the press stops, the used plate is removed from the plate cylinder and replaced with a new plate. It is important that the new plate be easily and accurately loaded onto the plate cylinder during this operation. One method used to load a plate onto a plate cylinder is disclosed in Japanese Laid-Open Patent No. 284252/1992 entitled "Device for Loading Plate on Plate Cylinder".

This method will be described with reference to FIGS. 6 and 7. In order to load a plate 53 onto the outer circumference of plate cylinder 51, as shown in FIG. 6, the plate cylinder 51 is equipped with a plate vice 52 for chucking the end portion of the plate 53. A housing 54, covering the plate cylinder 51 or the like, is opened at an entrance 55 facing the outer circumference of the plate cylinder 51. The entrance 55 is closed by a cover 56, while the plate cylinder 51 is rotating. When plate cylinder 51 is stopped for replacing the plate 53, cover 56 opens to expose plate 53. Cover 56 attaches to a plate receiver 57, a plate holder 58, a plate guide 59 and a plate tensioner 61.

According to the device described above, during the operation of the printing press, the entrance 55 is closed by the cover 56. Plate 62 is next loaded on the plate cylinder 51 at a position determined by the plate holder 58 and the plate receiver 57.

When the printing operation is complete, plate 53 is then replaced by another plate in the following manner. The cover 56 is first lifted, as shown in FIG. 7, to open the entrance 55. Then, the used plate mounted on the plate cylinder 51 is removed by opening the plate vice 52 and by rotating the plate cylinder 51. After the lower end portion of the plate 62, as indicated by a solid line, is removed from the plate holder 58 by the operator, and after it is inserted into the plate vice 52, as indicated by a double-dotted line, the plate 62 has its upper portion supported by the plate guide 59 and its lower end notches engaged with reference pins in the plate vice 52. When the upper end portion of plate 62 is inserted into the plate tensioner 61, plate 62 is warped into an arcuate shape and abuts against the combination of the plate tensioner 61, the plate guide 59 and the reference pins. This allows the lower end of plate 26 to be forcibly pushed onto the reference pins. When the plate vice 52 is then closed, the plate 62 has its lower end portion retained by the plate cylinder 51. Thus, according to this plate loading device, the plate can be efficiently replaced in a short time period.

However, when the plate 62 is to be loaded on the plate cylinder 51, it often becomes warped into an arcuate shape. In order to flatten plate 62, an elastic righting moment must be applied to the plate 62. This moment, however, causes the plate 62 to have its notches forcibly pushed onto the reference pins. As a result, after continuous loading and unloading of the plate 62 on and off the plate cylinder 51, the plate 62 may have its lower end gradually deformed or damaged. This deformation or damage in turn tends to deteriorate the printing accuracy of the printing operation.

SUMMARY OF THE INVENTION

The present invention has been conceived in view of the background described above and has as an object to provide a plate loading device for a printing press, which allows a plate to be loaded onto a cylinder accurately without the end portion of the plate being deformed or damaged, even after repetitious loading and unloading.

Basically, the invention is a method of loading a printing plate onto a printing press of the type having a rotatable plate cylinder. The method includes the step of providing the printing press with a movable cover, a set of opposed rollers mounted on the cover and one-way rotation limiting means operatively connected to at least one of the rollers. The plate is held in a generally vertical position on the movable cover. The cover and the plate are lifted to provide access to the plate cylinder. The plate is moved and guided between the set of opposed rollers toward the plate cylinder, where the rollers permit movement of the plate toward the plate cylinder for loading. The plate is prevented from moving in the opposite direction, away from the plate cylinder, through frictional engagement between the plate and the rollers. In a preferred method, the cover is retained in a lifted position during the loading of the plate. Also, the preferred method includes the step of supporting the lower or leading edge of the plate between the set of opposed rollers such that the plate is held in a stationary upright position.

Further, the invention is a plate loading apparatus for use with a printing press of the type having a rotatably mounted plate cylinder. The apparatus includes a movable cover for covering an entrance to the printing press and a plate holding structure mounted on the movable cover for holding a printing plate to be loaded in a generally upright position. The holding structure includes a lateral support member for contacting a surface of the plate. Further included is a set of opposed rollers mounted on the cover. At least one roller of the set is adapted to engage one side of the plate and at least one roller of the set is adapted to engage the opposite surface of the plate for clamping and guiding the plate as the plate is loaded towards the plate cylinder. Also included in the preferred embodiment is a one-way clutch device operatively connected to at least one of the rollers to permit this roller to rotate in a direction of rotation which, through frictional contact with the plate, permits the plate to move toward the plate cylinder and prevents the plate from moving in the opposite direction, away from the plate cylinder. In the preferred embodiment, the rollers are a pair mounted to a lower portion of the cover such that the axes of both rollers are perpendicular to a feeding direction of the plate. The pair is located in a contacting, opposed relationship such that a leading edge of a plate being supported prior to loading engages and is held by the pair.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

One embodiment of the present invention will be described in the following with reference to FIGS. 1 to 5.

Figure 2:
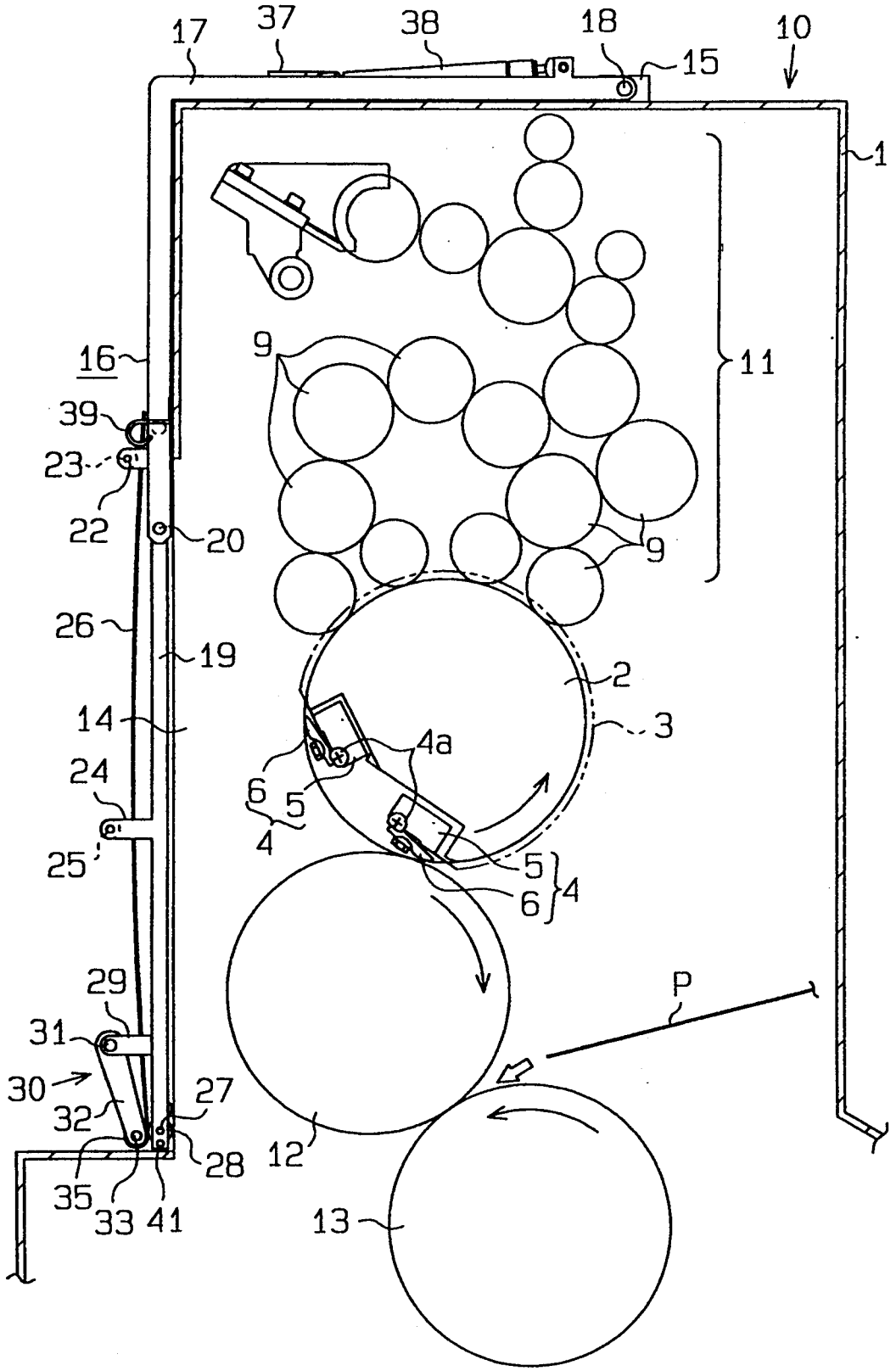
FIG. 2 is a sectional side elevation view illustrating the present invention in which a plate, held outside the printing press cover, is readied for loading on the plate cylinder in a plate replacement operation.

As illustrated in FIG. 2,a printing press 10 is encased by a housing 1, in which a cylindrical plate cylinder 2 is rotatably arranged to receive a removable flexible plate 3 around its outer circumference. The plate cylinder 2 has its outer circumference partially notched in order to engage a pair of plate vices 4 incorporated into the plate cylinder 2. Each plate vice 4 is equipped with a vice bed 5 and a chuck 6. The vice bed 5 is fixed in the plate cylinder 2 and extends in the axial direction (i.e., in the direction of thickness of the drawing) of the plate cylinder 2. The chuck 6 is pivotably attached to the vice bed 5 by means of a cam **4*a*, such that chuck 6 inclines in the radial direction toward or away from the circumference of plate cylinder 2. It is in this fashion that the gap between the vice bed 5 and the chuck 6 may be selectively widened or narrowed. As the gap is narrowed, the plate 3 has its end portion clamped between the vice bed 5 and the chuck 6 of the plate vice 4**.

Figure 5:
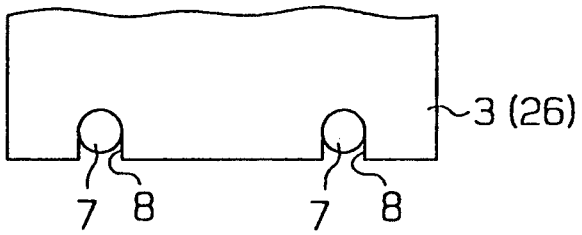
FIG. 5 is a sectional side elevation view illustrating the engagement of the printing plate notches and reference pins.
Figure 6:
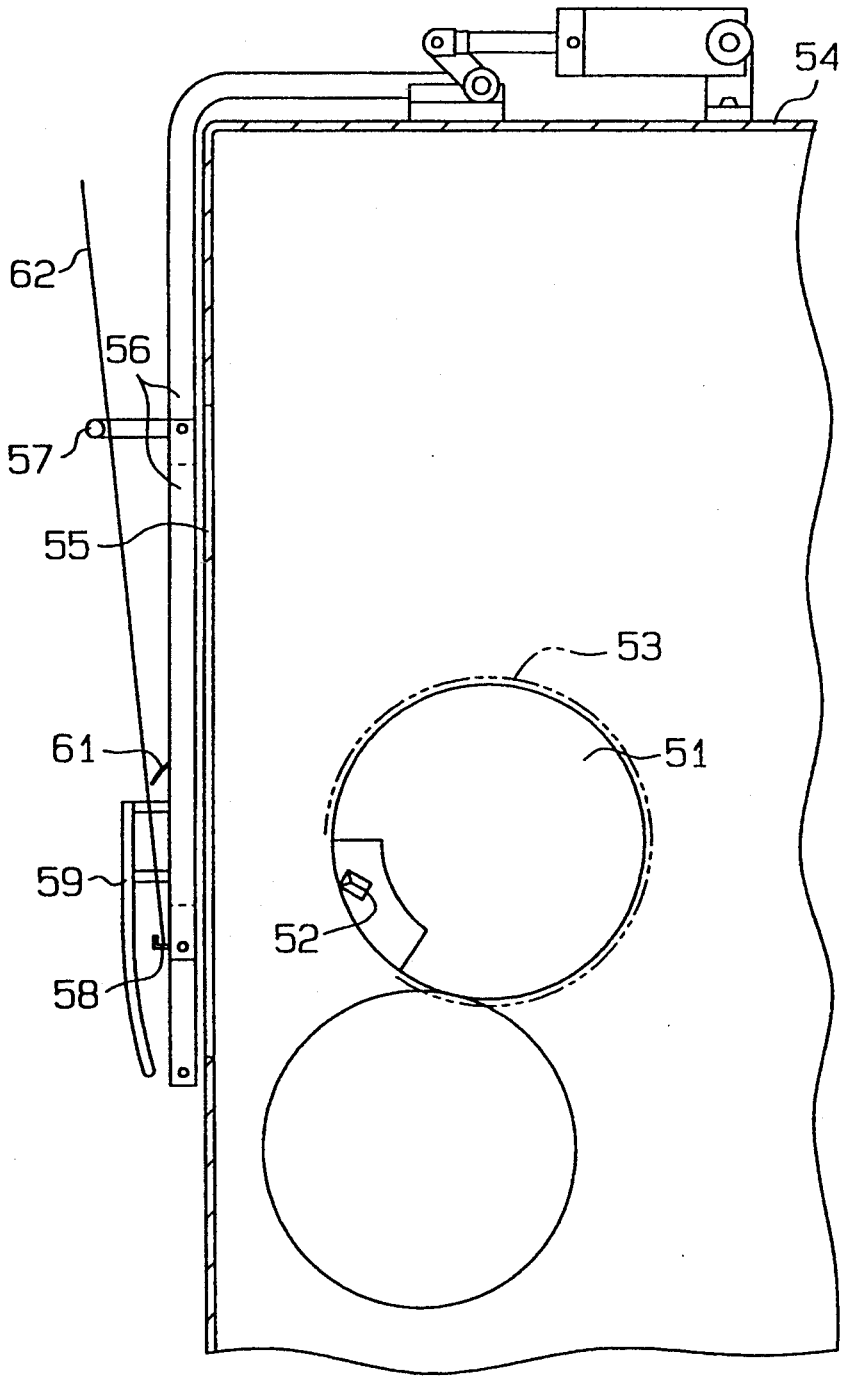
FIG. 6 (PRIOR ART)
FIG. 6 is a sectional side elevation view illustrating a prior art loading device where a plate awaiting loading onto the plate cylinder is held outside the printing press assembly.
Figure 7:
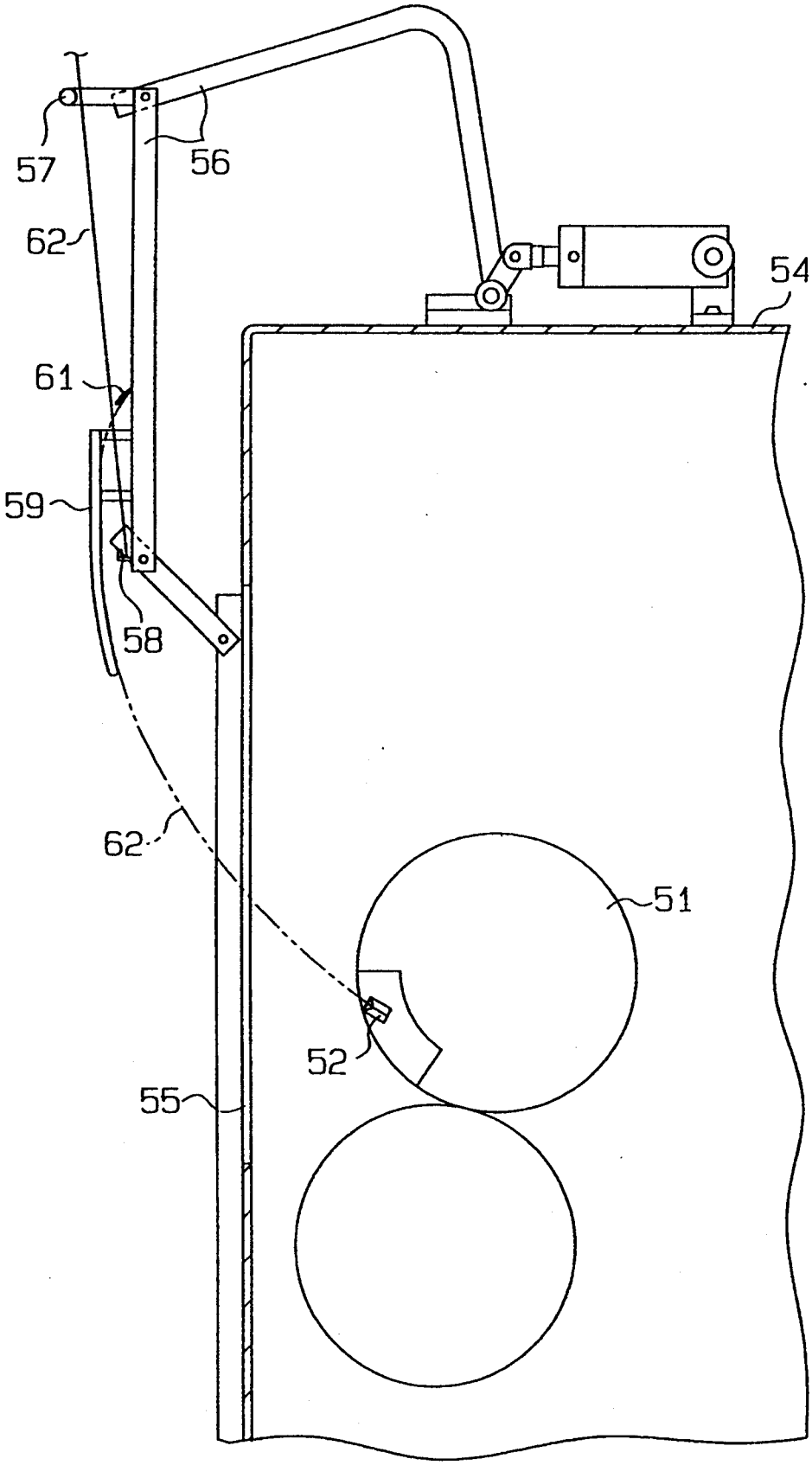
FIG. 7 (PRIOR ART)
FIG. 7 is a sectional side elevation view illustrating the mechanism by which a prior art loading device attaches a plate to a plate cylinder.

As shown in FIG. 5, a plurality of reference pins 7 are fixed on vice bed 5 and engage a plurality of corresponding notches 8 formed in the end portion of the plate 3. These reference pins 7 and notches 8 insure that plate 3 is accurately held in position while the plate 3 is loaded on the plate cylinder 2. Vice beds 5, chucks 6 and reference pins 7 form a retaining mechanism for chucking and retaining the two end portions of the plate 3 on the plate cylinder 2. On the side of the plate cylinder 2, in FIG. 2, a wetting device (not shown) is provided for feeding moisture to the plate 3 to be loaded on the plate cylinder 2. Above the plate cylinder 2, an inking device 11 is provided which is equipped with a number of rollers 9. This inking device 11 supplies ink to the surface of the plate 3.

Below the plate cylinder 2, a cylindrical rubber blanket cylinder 12 and a cylindrical press cylinder are rotatably arranged so that when printing press 10 is operated, plate 3 on the outer circumference of the plate cylinder 2 is turned in contact with the rollers of the wetting device and the rollers 9 of the inking device 11. As a result, the moisture and ink applied to the plate 3 are transferred to the rubber blanket cylinder 12. A printing paper P, fed from a paper feeding device(not shown) to the press cylinder 13, contacts the rubber blanket cylinder while being held and rotated together by the press cylinder 13. As a result of this contact, ink is applied from the rubber blanket cylinder to the printing paper P.

The aforementioned housing 1 is formed having an entrance 14 allowing communication between the inside and outside of the housing. This entrance 14 opens toward the outer circumference of the plate cylinder 2 so that a plate 26 can be inserted through the housing entrance to replace the plate 3 previously positioned on the plate cylinder 2.

Figure 3:
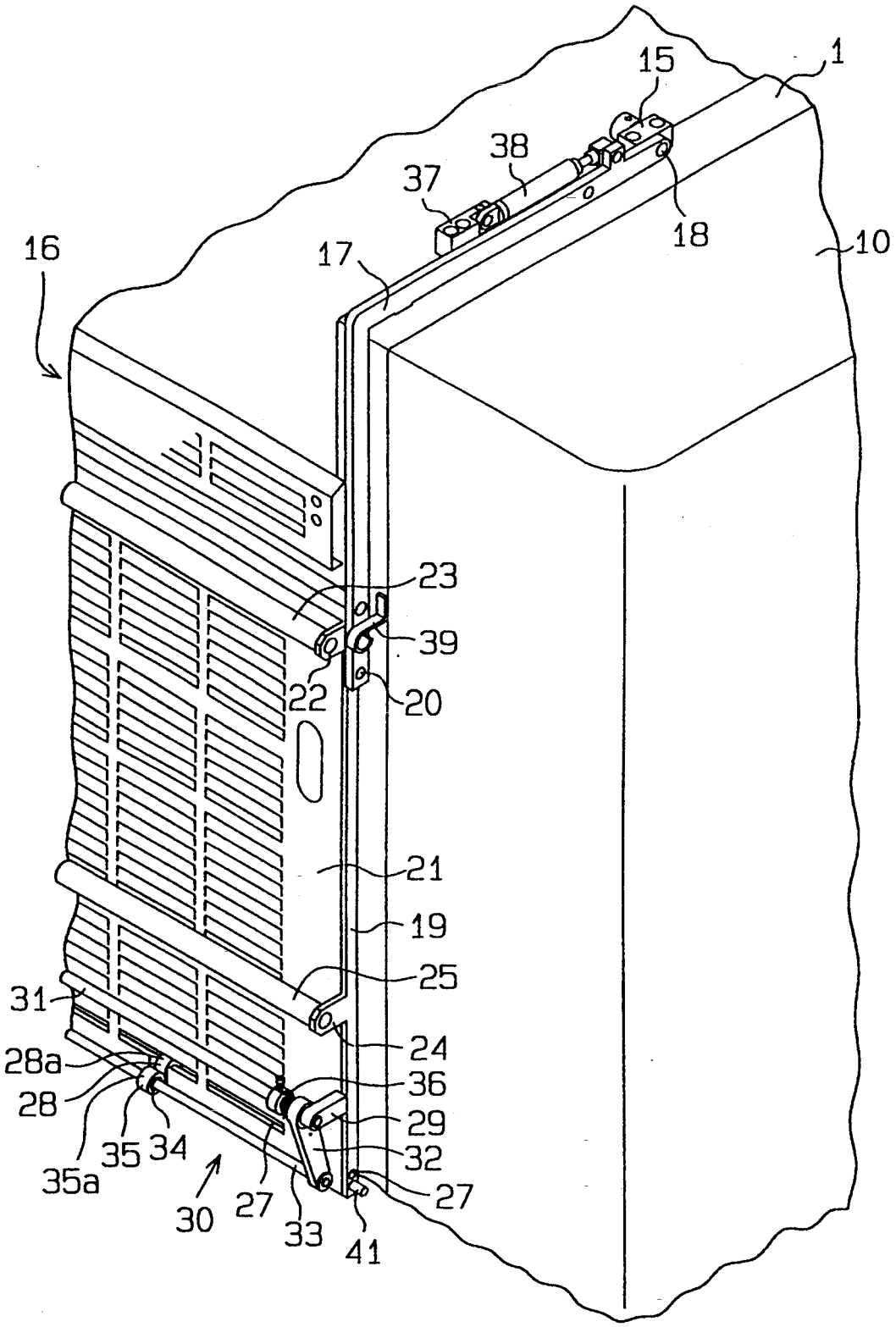
FIG. 3 is a perspective view of the invention in which a housing of the printing press has its entrance closed by a cover.

The housing 1 has a pair of projections 15 on its upper side (only one of which is shown in FIG. 3). Each projection attaches to a cover 16 for opening or closing the entrance 14. More specifically, a first arm 17, bent into the "L" shape, has a first end hinged to each projection 15 through a pin 18. A second end of arm 17 is hinged through a pin 20 to an upper end portion of an elongated second arm 19. To the righthand and lefthand arms 19, there is fixed a cover body 21 which serves to cover entrance 14.

This cover body 21 is equipped with structure for holding the plate to be loaded on the plate cylinder 2 in a substantially upright position outside of the cover 21, when the entrance 14 is closed by the cover 21. This holding structure will now be described. The two second arms 19 are formed at their upper end portions with projections 22, between which is mounted a horizontally elongated slender column-shaped handle 23. Likewise, at the middle section of the two second arms 19 projections 24 are formed and support a horizontally elongated slender column-shaped handle 25. These two handles 23 and 25 are disposed apart from the cover body 21 so that they can be grasped by the operator when the cover 16 is to be opened or closed. The two handles 23 and 25 also function as lateral support members for aligning the plate 26, which is threaded between them and the cover body 21 at an incline apart from the cover body 21.

In addition, the cover 16 has facing short column-shaped rollers 28 and 35 positioned at the lower end of cover 16 for clamping and holding the plate 26, awaiting loading onto plate cylinder 2. More specifically, the cover body 21 is constructed with a shaft 27 which rotatably supports a plurality of (although only one is shown) rollers 28 separated from each other. These rollers 28 are partially exposed on the outside of the cover body 21. The righthand and lefthand arms 19 are individually formed with projections 29, between which is fixed a pin 31. This pin 31 rotatably supports the upper ends of support arms 32. A shaft 33 is mounted between the lower end portions of these two support arms 32 and supports the rollers 35 through one-way clutches 34. Rollers 35 are positioned to face the rollers 28. The one-way clutches 34 direct the rotation of the rollers 35. In the present embodiment, the direction of rotation allowed by the clutches 34 is such that plate 26 is allowed to pass to the plate cylinder 2 (i.e., clockwise, as viewed in FIGS. 1 and 2).

The outer circumferences 28*a* of the inner rollers 28 and the outer rollers 35 are in contact with each other in such a way that they receive and support the lower end or leading edge of the plate 26 to be placed on plate cylinder 2. A coil spring 36, mounted on the outer circumference of each of the two end portions of the pin 31, has one end retained by the pin 31 and its other end retained by the support arm 32. These springs 36 bias the support arms 32 to turn counter-clockwise as viewed in FIGS. 1 and 2. In the present embodiment, the aforementioned projections 29, pin 32, support arms 32, shaft 33 and springs 36 form a mechanism 30 that biases the outer rollers 35 against the inner rollers 28. The bias mechanism 30, projections 22 and 24, handles 23 and 25, shaft 27 and rollers 28 and 35 function as a holding device.

A pair of brackets 37 are affixed to the righthand and lefthand sides of the upper portion of the housing 1. These brackets connect to a first arm 17 via a damper 38 which functions to dampen the upward and downward motions of the cover 16.

Pins 41 project from the lower end portions of the individual second arms 19. A pair of J shaped hangers 39 are fixed on the housing 1 in the vicinity of the righthand and lefthand sides of the entrance 14 so as to receive the pins 41. The two hangers 39 function to retain the cover body 21, which is lifted to open the entrance 14. According to the present embodiment, when the plate cylinder 2 is rotated during printing operations, the operator manipulates both the first arm 17 and the second arm 19 toward the housing 1, as shown in FIG. 2, in order to close the entrance 14 with the cover 16. Then, the operator holds the plate 26 to be loaded next on the plate cylinder 2, in a generally vertical position outside of the cover 16. While in this position, the lower end of the plate 26 is received and supported by the opposed outer circumferences 28*a* and 35*a* of the rollers 28 and 29 so that the plate 26 has its upper end portion and middle portion abutting against the handles 23 and 25.

When a currently used plate 3 is to be replaced by the plate 26 after a particular printing operation, the operator stops the operation of the printing press 10 and uses the handle 23 (or 25) to lift the cover 16. Then, the first arms 17 are turned clockwise on pins 18, as viewed in FIG. 2, so that the lower ends of the second arms 19 connected to the first arms 17 are lifted along the wall of the housing 1. At this time, the plate 26 is lifted together with the cover body 21, while being supported by the two rollers 28 and 35 and handles 23 and 25. As a result, the entrance 14 is opened as the cover body 21 and the plate 26 both rise.

Figure 4:
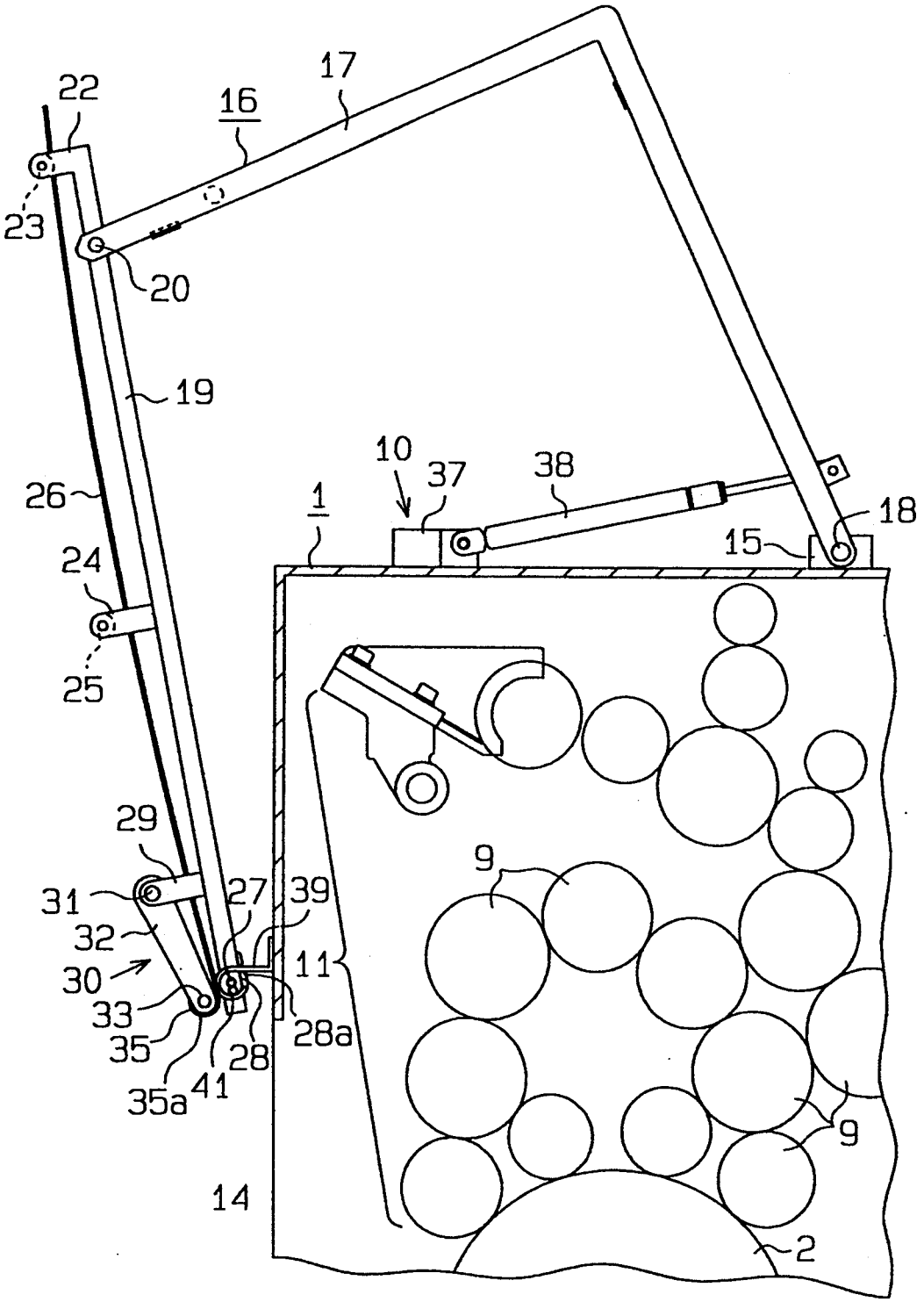
FIG. 4 is a sectional side elevation view showing a portion of the printing press in which a plate, prior to being loaded on the plate cylinder, is raised together with the cover.

When the entrance 14 is completely open, the operator brings the pins 41 at the lower ends of the second arms 19 into engagement with the hangers 39, as shown in FIG. 4. As a result, the second arms 19 are retained in a position that leaves the entrance 14 open. Since, at this time, the rollers 35 are sufficiently urged against the rollers 28, the plate 26 is prevented from falling down by its own weight from between the rollers 28 and 35.

After the entrance 14 is opened, the operator inclines the chucks 6 by turning the cams 4*a* of the two plate vices 4 and by turning the plate cylinder 2 to take out the used plate 3 from the plate cylinder 2.

Figure 1:
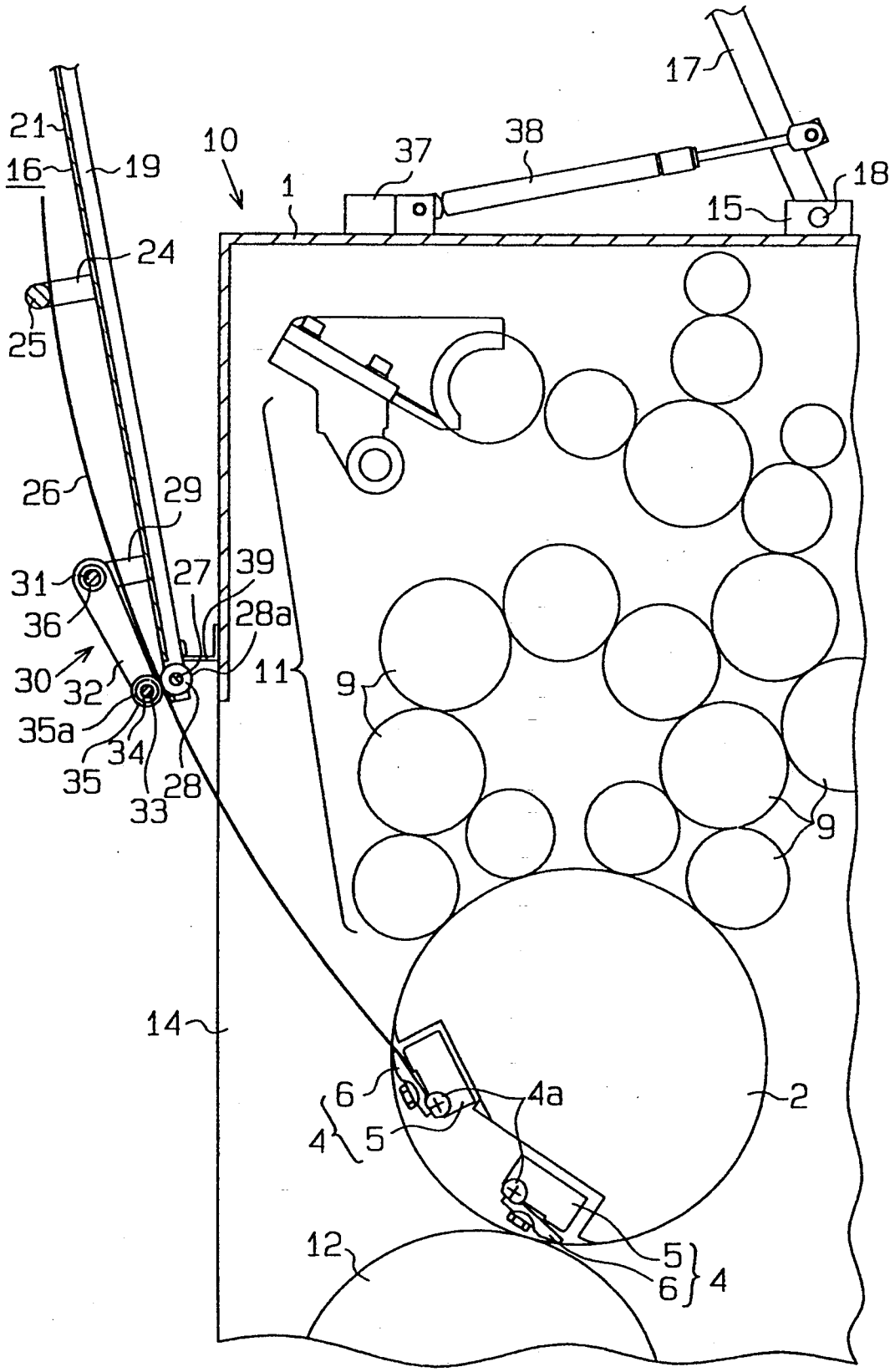
FIG. 1 is a sectional side elevation view illustrating the structure and operation in which a plate has its lower end portion inserted into a plate vice of a plate cylinder.

Next, the operator positions the plate cylinder 2, as shown in FIG. 1, and pushes the upper end of the plate 26 held on the cover 16 downward. Then, the lower end of the plate 26 passes between and is guided by the two rollers 28 and 35. The operator grips and pulls up the lower end portion of the plate 26 and inserts it into the housing 1 through the entrance 14. Specifically, the operator inserts the lower end portion of the plate 26 into the clearance between the vice bed 5 and the chuck 6. During this insertion, the operator causes the notches 8 to engage the reference pins 7. The operator then turns the cams 4*a* and closes the chucks 6 when the notches 8 engage pins 7.

The rotational direction of the rollers 35 is determined by the clutches 34. In other words, these clutches 34 allow the rollers 35 to rotate in a direction that allows the plate 26 to pass toward the plate cylinder 2. As a result, the plate 26, having once passed between the two rollers 28 and 35, is prevented from sliding back in the opposite direction due to frictional engagement between the rollers 28, 35 and the plate 26. Thus, the engagement of the notches 8 with the reference pins 7 is maintained even if the hand of the operator leaves the plate 26.

When the chucks 6 are closed, as described above, the lower end of plate 26 is retained on the plate cylinder 2. After this, the operator turns the plate cylinder 2 to wind the plate 26 on its outer circumference and clamps the trailing end portion of the same plate 26 by the other plate vice 4. This completes the plate replacement operation.

In this way, according to the present embodiment, the rollers 28 and 35 clamp the plate 26 and allow it to move only in one direction. By engaging the notches 8 of plate 26 with the reference pins 7 and closing plate vices 4, the plate 26 can be loaded in the proper position on cylinder 2.

Moreover, the present embodiment prevents the plate 26 from warping, since the notches 8 of the plate 26 are to be brought into engagement with the reference pins 7. As a result, even with repeated loading and removal of the plate 26, the lower end of plate 26 will not be deformed or damaged by the aforementioned pressing action.

In the present embodiment, moreover, the opposed rollers 28 and 35 function to clamp the plate 26 and to block the backward movement of the plate 26. Thus, the number of parts can be reduced, as compared with the prior art which must be separately equipped with a plate holder 58 for holding the plate 62 and a plate tensioner 61 for pressing the plate 62 downward when the plate 62 is loaded on the plate cylinder 51.

In the prior art, moreover, the positioning of the plate 62 requires the operation of gripping the plate 62 to remove it from the plate holder 58, the operation of inserting the lower end portion of the plate 62 into the plate vice 52 in the open state, and the operation of warping the plate 62 to insert its upper end into the plate tensioner 61. In the present embodiment, all that is necessary is to pull down the plate, retained between the rollers 28 and 35, and to insert its lower end into the plate vices 4. Thus, compared to previous printing operations, the positioning of the plate 26 with respect to the plate cylinder 2 is accomplished in a simple operation.

In the present embodiment, moreover, the rollers 35 are always biased toward the opposed rollers 26 by the springs 36. As a result, increasing the pressure exerted by the rollers 28 and 35 upon the plate 26 is more easily accomplished than when the plate 26 is clamped by the two rollers 28 and 35 without using a biasing member. As a result, the plate 26 can be securely held during printing operations by the two rollers 28 and 35. This contact between rollers 28 and 35 moreover prevents the plate 3 from moving backward when a plate is to be loaded on the plate cylinder 2.

Although only one embodiment of the present invention has been described herein, it should be apparent to those skilled in the art that the present invention may be embodied in many other specific forms without departing from the spirit or scope of the invention. Particularly, it should be understood that the present invention could be embodied in the following modes.

(1) The notches 8 may be omitted from the plates 3 and 26 so that these plates 3 and 26 can be positioned to have their end edges abutting the reference pins 7.

(2) The one-way clutches 34 interposed between the shaft 33 and the outer rollers 35 may be interposed between the shaft 27 and the inner rollers 28. These clutches 34 may be interposed between the shaft 27 and the inner rollers 28.

(3) In order to bias the outer rollers 35 onto the inner rollers 28, elastic forces produced by the compression springs or tensile coil springs may be utilized in place of the torsional coil springs 36.

(4) Rollers 28 and 35, among others may be made of an elastic material such as rubber, and may abut each other. With this construction, the bias mechanism 30 can be omitted.

(5) The rollers 28 and 35 may be formed into columns having lengths substantially equal to that of the handles 23 and 25 so that they may clamp the plate 26 over its substantial width.

(6) The minimum requisite function of the two rollers 28 and 35 is to clamp the plate 26, which is inserted through the entrance 14 into predetermined positions of the plate vices 4, at the time of replacing the plate. This prevents the plate 26 from returning upward. A mechanism for holding the plate 26 in a substantially vertical position is separately provided by the two rollers 28 and 35. Receiving members such as the plate holders of the prior art may be disposed just above the rollers 28 and 35.

What is claimed is:

1. A method of loading a printing plate onto a printing press of the type having a rotatable plate cylinder, the method comprising the steps of:

a) providing the printing press with a movable cover, a set of opposed rollers mounted on the cover and one-way rotation limiting means operatively connected to at least one of the rollers;

b) holding a plate in a generally vertical position on the movable cover;

c) lifting the cover and the plate to provide access to the plate cylinder;

d) moving and guiding the plate between the set of opposed rollers toward the plate cylinder, wherein the rollers permit movement of the plate toward the plate cylinder for loading; and e) preventing the plate from moving in the opposite direction, away from the plate cylinder, through frictional engagement between the plate and the rollers.

2. The method of claim 1 including the step of retaining the cover in a lifted position during the performance of steps d) through e).

3. The method of claim 1 wherein step b) includes the step of supporting the lower or leading edge of the plate between the set of opposed rollers such that the plate is held in a stationary upright position.

4. A plate loading apparatus for use with a printing press of the type having a rotatably supported plate cylinder, the apparatus comprising:

a) a movable cover mounted on the press;

b) means for holding a plate in a generally vertical position on the cover;

c) means for lifting the cover and the plate to provide access to the plate cylinder;

d) means for moving and guiding the plate towards the plate cylinder to engage the plate cylinder for loading, wherein the moving and guiding means includes a set of opposed rollers between which the plate passes and frictionally engages during loading; and e) means for preventing the plate from moving in the opposite direction, away from the plate cylinder, including one-way rotation limiting means operatively connected to at least one of the rollers.

5. The apparatus of claim 4 including means for retaining the door in a lifted position during loading of a plate.

6. The apparatus of claim 4 wherein the opposed rollers are constructed and arranged to support the lower or leading edge of the plate between them such that the plate is held in a stationary upright position prior to being loaded.

7. A plate loading apparatus for use with a printing press of the type having a rotatably mounted plate cylinder, the apparatus comprising:

a) a movable cover for covering an entrance to the printing press;

b) plate holding structure mounted on the movable cover for holding a printing plate to be loaded in a generally upright position, the holding structure including a lateral support member for contacting a surface of the plate;

c) a set of opposed rollers mounted on the cover, at least one roller of the set being adapted to engage one side of the plate and at least one being adapted to engage the opposite surface of the plate for clamping and guiding the plate as the plate is loaded towards the plate cylinder; and d) one-way clutch means operatively connected to at least one of the rollers to permit the at least one roller to rotate in a direction of rotation which, through frictional contact with the plate, permits the plate to move toward the plate cylinder and prevents the plate from moving in the opposite direction, away from the plate cylinder.

8. The apparatus of claim 7 wherein the set of rollers is a pair of rollers and the pair of rollers is mounted to a lower portion of the cover such that the axes of both rollers are perpendicular to a feeding direction of the plate and wherein the pair is located in a contacting, opposed relationship such that a leading edge of a plate being supported prior to loading engages and is held by the pair.

9. The apparatus of claim 7 wherein said cover includes spring biasing means for urging at least one of said rollers toward another of said rollers.

10. The apparatus of claim 9 wherein said spring biasing means includes a pin spaced from said cover, a support arm pivotable about said pin, a shaft mounted at one end of said arm supporting a roller, and a spring mounted on the pin for biasing the support arm.

11. The apparatus of claim 7 wherein said lateral support member also serves as a handle for lifting the cover.

12. A plate loading apparatus for use with a printing press of the type having a rotatably mounted plate cylinder, the apparatus comprising:

a) a movable cover for covering an entrance to the printing press; and b) plate supporting structure mounted on the movable cover for supporting a printing plate to be loaded in a generally upright position, the supporting structure including:

a lateral support member for contacting a surface of the plate; and a pair of opposed rollers mounted on the cover, at least one roller being adapted to engage one side of the plate and the other being adapted to engage the opposite surface of the plate wherein the pair of rollers is mounted to a lower portion of the cover such that the axes of both rollers are perpendicular to a feeding direction of the plate and wherein the pair is located in a contacting, opposed relationship such that a leading edge of a plate being supported prior to loading engages and is held by the pair.

13. The apparatus of claim 12 including one-way clutch means operatively connected to at least one of the rollers to permit the at least one roller to rotate in a direction of rotation which, through frictional contact with the plate, permits the plate to move toward the plate cylinder and prevents the plate from moving in the opposite direction, away from the plate cylinder.

14. The apparatus of claim 12 wherein said cover includes spring biasing means for urging at least one of said rollers toward the other of said rollers.

15. The apparatus of claim 14 wherein said spring biasing means includes a pin spaced from said cover, a support arm pivotable about said pin, a shaft mounted at one end of said arm supporting a roller, and a spring mounted on the pin for biasing the support arm.

16. The apparatus of claim 12 wherein said lateral support member also serves as a handle for lifting the cover.

* * * * *